United States Patent [19]

Delaballe et al.

[11] Patent Number: 4,459,570

[45] Date of Patent: Jul. 10, 1984

[54] ULTRA-HIGH FREQUENCY FILTER WITH A DIELECTRIC RESONATOR TUNABLE IN A LARGE BAND WIDTH

[75] Inventors: Jacques Delaballe; Jean Fouillet; Yves Le Nohaic, all of Paris, France; Alexandre Osias, Paris, France, Dorine Osias, administratrix

[73] Assignee: Thomson-CSF, Paris, France

[21] Appl. No.: 296,587

[22] Filed: Aug. 27, 1981

[30] Foreign Application Priority Data

Aug. 29, 1980 [FR] France ..... 80 18771

[51] Int. Cl.[3] ..... H01P 1/20; H01P 7/00; H01P 1/202

[52] U.S. Cl. ..... 333/202; 333/207; 333/219; 333/235

[58] Field of Search ..... 333/202, 204–209, 333/219, 222, 224, 226–227, 231, 234–235, 245, 248

[56] References Cited

U.S. PATENT DOCUMENTS

| | | | |
|---|---|---|---|
| 3,475,642 | 10/1969 | Karp et al. | 333/227 |
| 3,713,051 | 1/1973 | Kell | 333/202 |
| 4,184,130 | 1/1980 | Nishikawa et al. | 333/206 |

FOREIGN PATENT DOCUMENTS 2355403 1/1978 France .

OTHER PUBLICATIONS

Harrison, "Microwave Filters Utilizing Dielectric Resonators", Technical Report Ecom-02088-4, U.S. Army Electronics Command, Fort Monmouth, N.J., Title Page and pp. 5–10, (Scientific Library, Apr. 25, 1973).

Pospieszalski, IEEE Trans. on Microwave Theory and Techniques, vol. MTT-27, No. 3, Mar. 1979, pp. 233–238.

Plourde et al., IEEE MTT-S International Microwave Symposium, Jun. 21–23, 1977, San Diego, New York, (U.S.), pp. 290–293.

Patent Abstracts of Japan, vol. 4, No. 14, Jan. 31, 1980, p. 131E169.

Gerdine, "A Frequency-Stabilized Microwave Band-Rejection Filter Using High Dielectric Constant Resonators", IEEE Trans. on Microwave Theory and Techniques, vol. MTT-17, No. 7, Jul. 1969, pp. 354–359.

*Primary Examiner*—Marvin L. Nussbaum

[57] ABSTRACT

A dielectric resonator ultra-high frequency filter tunable in a large band width in which each dielectric resonator is constituted by a dielectric component with a high dielectric constant, which is fixed relative to an enclosure and a component made from the same dielectric material which is movable relative to the first component, in such a way that the distance d between facing surfaces of these two dielectric components varies, leading to a variation in the tuning frequency of the filter by modifying the coupling conditions.

5 Claims, 3 Drawing Figures

ULTRA-HIGH FREQUENCY FILTER WITH A DIELECTRIC RESONATOR TUNABLE IN A LARGE BAND WIDTH

BACKGROUND OF THE INVENTION

The present invention relates to ultra-high frequency (UHF) filters and more particularly to a dielectric resonator UHF filter tunable in a large band width.

UHF transmission equipment, e.g. for military purposes, increasingly has to work successively on a number of tuning frequencies. Moreover, fixed frequency civil transmission equipment can also be constructed on the base of standard tunable components, tuning to the fixed working frequency being determined on site by regulating these tunable standard components. The need to produce such tunable components, particularly ultra-high frequency filters, has made it necessary to develop tuning methods such that the filter retains clearly defined characteristics in a tuning band width which is as large as possible in order to cover with a given standard component a wide frequency band, without the characteristics of the component being impaired in said tuning band and in particular the filter response curve, the overvoltage coefficient, coupling, etc.

BRIEF SUMMARY OF THE INVENTION

The present invention relates to a dielectric resonator UHF filter, tunable in a large band width and which satisfies the aforementioned conditions.

In the known dielectric resonator UHF filters fine tuning of the tuning frequency of the filter is brought about by means of a metal screw, whose penetration can be varied. The control of this metal screw then makes it possible to adjust the tuning frequency of the filter to the nominal frequency. However, this only leads to a limited control range and does not make it possible to obtain UHF filters with a large band width.

The present invention therefore relates to a dielectric resonator ultra-high frequency filter, comprising a waveguide and at least one dielectric resonator coupled to the guide, wherein each resonator comprises a first component made from a dielectric material and fixed relative to the guide and a second component made from a dielectric material which is movable relative to the guide and which has a facing surface with respect to the first component, the distance between these two surfaces being variable and enabling the filter to be tuned in a large band width.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

In general terms an ultra-high frequency filter is designed as a function of a certain number of parameters including the operating frequency and the width of the transmission or rejection band, depending on whether band pass or band stop filters are involved. The band width determines the number of poles of the filter and this number determines the number of resonators arranged along the propagation direction, as well as their spacing. The resonators can be made from a dielectric material having a high dielectric constant, but whose dimensions are stable as a function of the temperature. If this is not the case the characteristics of the filter will depend considerably on the temperature, which should, as far as possible, be avoided. The material must have a high dielectric constant, so that the resonator has an adequate action, while maintaining small dimensions, making it possible to limit the overall dimensions of the equipment.

In the UHF filters according to the invention the tuning frequency for each resonator is controlled by a dielectric component whose dimensions are similar to those of the fixed component facing it and located at a variable distance from the first component, the assembly forming the resonator. The displacement of the second component modifies the tuning frequency and makes it possible to cover a broad band.

Figure 1:
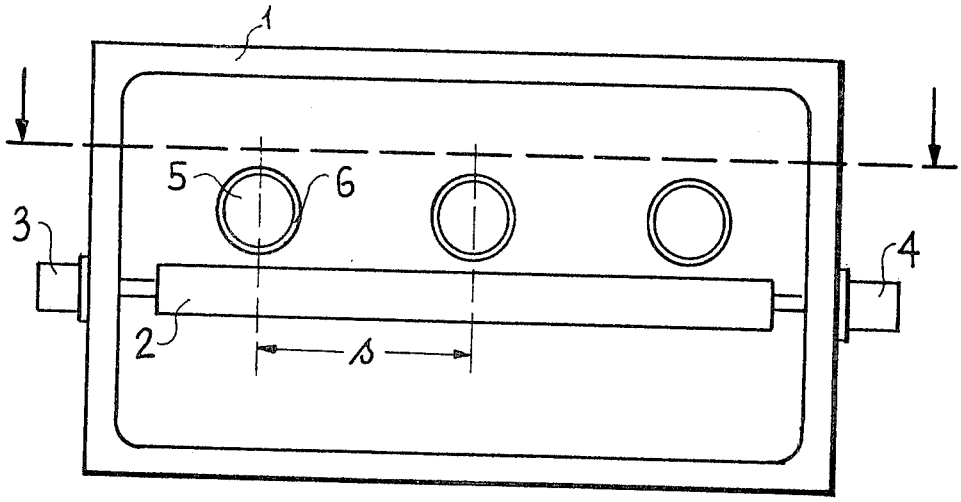
FIGS. 1 and 2 show a tunable band stop filter according to the invention, respectively in plan view with the cover removed and in cross-section with the cover down.
Figure 2:
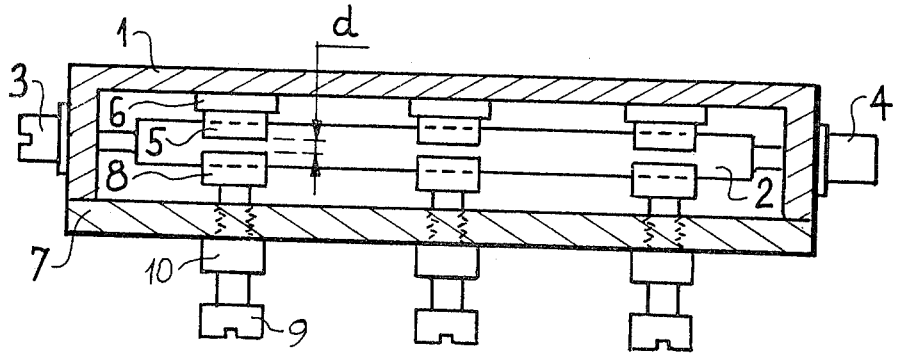

FIGS. 1 and 2 show an embodiment of a band stop filter according to the invention, respectively in plan view with the cover removed and in cross-section with the cover down. The same references in both drawings designate the same components.

In FIG. 1 conductive enclosure 1 and line 2 form a coaxial line. An input plug 3 and an output plug 4 are fixed to the enclosure, the coaxial line being connected to the two plugs.

The represented embodiment is a filter with three resonators. Each resonator comprises a fixed component 5, constituted by a dielectric pellet placed at a certain distance from the coaxial line (the fixed components are only visible in FIG. 1) glued to the bottom of the box on a supporting washer or pellet such as 6. When the assembly is closed by cover 7 movable dielectric components 8, which are similar to the fixed components, face the fixed dielectric components such as 5. Control supports such as 9, associated with nuts 10 accessible on the outer face of cover 7 make it possible to vary the penetration of the movable dielectric components and consequently the spacing d between fixed components 5 and movable component 8 forming the resonator. The control supports can be of a random nature, i.e. metallic or dielectric, because they have no influence on the propagation in the line and from which they are spaced by an adequate distance. The length of line s between the resonators is a function of the wavelength: $s=(2n+1)(\lambda_o/4)$ in which n is an integer. Such a filter functions in the following manner. The input plug is directly connected to the coaxial line and excites the line according to the coaxial TEM mode. The enclosure merely serves to position with respect to the said line the resonators which interfere with the field lines by the effect of the rejector or band stop circuits connected in series on the transmis;sion line. The coupling of the resonator to this coaxial line of characteristic impedence $Z_c$ brings a band stop circuit to the tuning frequency $f_o$ and the circuit then behaves in the manner of an open circuit causing an attenuation of amplitude A at frequency $f_o$. The cross-section of the dielectric tuning pellet can be equal to, larger than or smaller than that of the fixed pellet, the penetration necessary for a given variation in the tuning frequency being adjustable. Thus, the relative dimensions of these two components are not critical. Furthermore the axial alignment of these two components is not brought about with a great precision.

The movable tuning component made from a dielectric material in the same way as the fixed component has a considerable influence on the characteristics of the resonator constituted by the said fixed and movable components. If these two components are made from the same material with a dielectric constant $\epsilon$ of approximately 40, the frequency variation which can be obtained is approximately 10% of the center frequency of the band for a limited travel, approximately the same as that of the metallic tuning screws of the prior art means for which the frequency variation can only be approximately 1% of the center frequency.

As a non-limitative example the dielectric material can be zirconium titanate, whose dielectric constant is $\epsilon=36$ and which has an adequate thermal stability.

Figure 3:
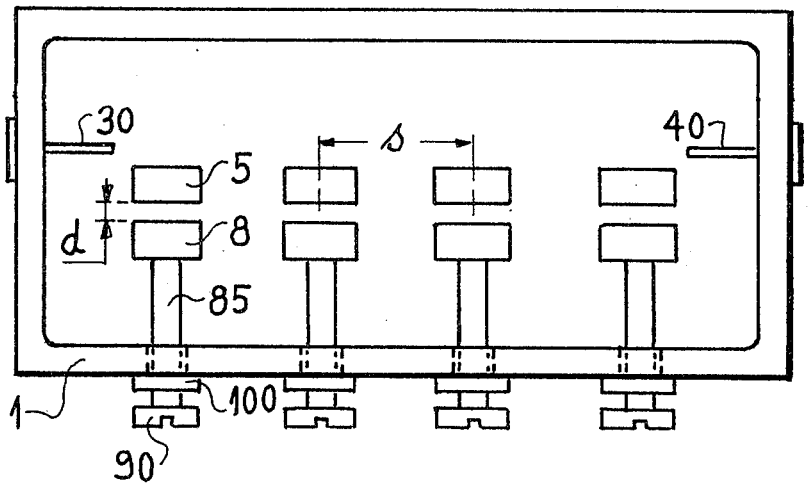
FIG. 3 shows a tunable band pass filter according to the invention.

FIG. 3 shows a band pass UHF filter, which can be tuned in a large band width according to the invention.

As in the previous case the filter can be produced with dielectric resonators, whose number determines the number of filter poles having a high dielectric constant. However, in such a filter the propagation mode is a $TM_{01}$ mode guided in the microwave circuit formed by an enclosure provided with its cover.

Thus, the filter comprises an enclosure 1, an input dipole 30 and an output dipole 40. It also comprises four resonators constituted by a fixed dielectric component and a movable dielectric component. The movable components are carried by rods 85, which are also made from a dielectric material and accessible from the outside of the cover by setscrews 90 locked by nuts 100. The input signal excites the magnetic dipole mode of the dielectric resonator closest to the input line. Transmission is brought about step by step by coupling magnetic field lines of a dielectric resonator to the following resonator by evanescent waves up to the output line. The coupling coefficient between two consecutive resonators is a function of the distance s separating them.

In this filter each resonator is in practice constituted by the fixed dielectric component 5, the facing movable dielectric component 8 and the supporting dielectric rod to which the latter is connected. The tuning frequency of this resonator depends on the distance d separating the facing components. The electric field in the gap between the two dielectric material cylinders increases in proportion with the ratio D/h (D being the diameter of the cylinders and h their height). For a constant diameter the tuning frequency variation rises in inverse proportion to the height of the movable cylinder. As in the previous case the variation of the tuning frequency relative to the center frequency of the tuning band can be approximately 10 to 15%. For example the embodiment shown in FIG. 3 has made it possible to obtain around 7 GHz a tuning frequency variation in a band of 500 MHz with zirconium titanate dielectric pellets ($\epsilon=36$).

The dimensions of the dielectric components and the spacing of the resonators have been selected so that the overvoltage coefficient remains high. Thus, if possible, D/s should vary between 0.3 and 1.

Due to the fact that the volume of the resonators is not significantly changed in the tuning range, the coupling conditions between the resonators remain roughly unchanged throughout the tuning range, so that no interference results from this tuning.

As in the first embodiment the dielectric material chosen for producing the resonators has a maximum dielectric constant, the limitation generally being imposed by the thermal behavior in such a way that resonators can have a minimum volume, bearing in mind the requisite performance levels (high operating frequencies in the frequency bands 3.8 to 4.2 GHz and 6.4 to 7.1 GHz).

It should be noted that the tuning frequency variation compared with the center frequency of the tuning band need not always be approximately 10%. For such applications it is possible to design the filter according to the invention so as to improve the stability of its characteristics, particularly its band width. In the case, for example, where this variation of the tuning frequency does not have to exceed 5%, it is possible to very significantly reduce the pass band variations due to the modifications of the tuning frequency. For this purpose the dielectric constant of the movable components is chosen between 15 and 20 and is no longer approximately 40, while the dielectric constant of the fixed components remains approximately 40. Thus, the interference introduced into the electromagnetic field about the fixed components of the resonators by the approach of the movable components is reduced. Experience has shown that under the above conditions, i.e. for a tuning frequency variation which does not have to exceed 5% and movable components with a dielectric constant between 15 and 20, the variations of the filter band width are reduced in a ratio of about 2 to 3 compared with the same filters, but having movable components with a dielectric constant of approximately 40.

The invention is not limited to the embodiments described hereinbefore. It can be realized in any tunable UHF filter in which the filtering function is performed by dielectric resonators. Each resonator then comprises a fixed dielectric component and a movable dielectric component separated by a variable distance for modifying the tuning frequency.

What is claimed is:

1. A dielectric resonator ultra-high frequency filter, comprising a hollow rectangular enclosure, input and output plugs fixed to said enclosure, and at least one dielectric resonator placed inside said enclosure and which comprises a first component made from a dielectric material and fixed relative to the enclosure, and a second component made from a dielectric material, the dielectric constant of the second component having a value approximately half the value of the dielectric constant of the first component, the second component being movable relative to the enclosure and having a facing surface with respect to a surface of the first component, the distance between said two surfaces being variable and enabling the filter to be tuned in a large band width.

2. A filter according to claim 1, wherein the two components are constituted by cylinders made from a dielectric material with a high dielectric constant, having a thermal behavior such that the dimensions of the components are not significantly modified when the temperature varies.

3. A filter according to claim 1, wherein the dielectric material of the resonator is zirconium titanate.

4. A filter according to claim 1, wherein the enclosure forms a waveguide in which electromagnetic waves are guided, the resonators placed within the guide modifying by their movable components the coupling conditions within the guide and the corresponding tuning frequency.

5. A filter according to claim 1, wherein a coaxial line is connected to said input and output plugs, said line being located within the enclosure, the axis of each resonator being placed at a predetermined distance from said line, the resonators placed in this way in the vicinity of the line, in conjunction with the line defining attenuation poles so as to form band stop circuits with a frequency variable with the position of the movable component compared with that of the fixed component.

* * * * *